United States Patent [19]

Peck

[11] Patent Number: 4,572,777

[45] Date of Patent: Feb. 25, 1986

[54] RECOVERY OF A CARBONACEOUS LIQUID WITH A LOW FINES CONTENT

[75] Inventor: Lawrence B. Peck, Glenn Ellyn, Ill.

[73] Assignee: Standard Oil Company (Indiana), Chicago, Ill.

[21] Appl. No.: 584,719

[22] Filed: Feb. 29, 1984

Related U.S. Application Data

[63] Continuation-in-part of Ser. No. 449,607, Dec. 14, 1982.

[51] Int. Cl.[4] ..... C10G 1/04

[52] U.S. Cl. ..... 208/11 LE

[58] Field of Search ..... 208/11 LE, 8 LE

[56] References Cited

U.S. PATENT DOCUMENTS

| | | | |
|---|---|---|---|
| 3,475,318 | 10/1969 | Gable et al. | 208/11 LE |
| 3,723,310 | 3/1973 | Lang et al. | 208/11 LE |
| 3,779,902 | 12/1973 | Mitchell et al. | 208/11 LE |
| 4,036,732 | 7/1977 | Irani et al. | 208/11 LE |
| 4,094,781 | 6/1978 | Snell et al. | 208/11 LE |
| 4,229,281 | 10/1980 | Alquist et al. | 208/11 LE |
| 4,347,118 | 8/1982 | Funk et al. | 208/11 LE |
| 4,455,216 | 6/1984 | Angevine et al. | 208/11 LE |

OTHER PUBLICATIONS

Mitchell and Speight, Fuels, 52, 149 (1973).
Fritschy and Papirer, Fuel, 57, 701 (1978).

*Primary Examiner*—John Doll
*Assistant Examiner*—A. Pal
*Attorney, Agent, or Firm*—John B. Goodman; William H. Magidson; William T. McClain

[57] ABSTRACT

A method is disclosed for recovering bitumen from a carbonaceous solid feed and for recovering a carbonaceous liquid from a fines-containing carbonaceous liquid feed by extraction of the feed with a solvent of predetermined solvency power, wherein the recovered product has a low fines content.

10 Claims, 9 Drawing Figures

RECOVERY OF A CARBONACEOUS LIQUID WITH A LOW FINES CONTENT

BACKGROUND OF THE INVENTION

1. Reference to Related Application

This is a continuation-in-part application of copending application Ser. No. 449,607, "Recovery of a Carbonaceous Liquid with a Low Fines Content", L. B. Peck, and filed Dec. 14, 1982.

2. Field of the Invention

This invention relates generally to a method for extracting bitumen from a carbonaceous solid containing extractable bitumen and more particularly concerns a method for extracting bitumen from a carbonaceous solid or carbonaceous liquid containing extractable bitumen by forming a mixture of dissolved bitumen, undissolved bitumen, sand fines and a solvent wherein the sand fines are removed from the mixture by the undissolved bitumen.

3. Description of the Prior Art

Various methods have been proposed in the past for the recovery of bitumen from a carbonaceous solid containing extractable bitumen, such as tar sand, diatomaceous earth or any other solid containing a heavy oil. One such method utilizes the technique of solvent extraction. A serious problem, however, in using a solvent extraction process to remove bitumen from such a carbonaceous solid is that fines, primarily particles less than 50 microns in diameter, are carried over in the solvent-dissolved bitumen extract. The presence of the fines and the failure to remove the fines result in a high-ash bitumen product as well as problems with plugging of equipment used in the separation process, for example, especially filtration equipment. Similar problems arise when other carbonaceous liquids besides bitumen, such as coal liquid or shale oil, are used. Removal of the fines during recovery of the bitumen from a carbonaceous solid or from a previously recovered carbonaceous liquid, is therefore important in providing a desirable low-ash liquid product and minimizing fouling and plugging of equipment used in the process. It would be highly desirable to develop an extraction method for recovering bitumen from the aforesaid carbonaceous solids and for removing fines from the aforesaid carbonaceous liquids which would permit control of the solvency power of the extraction solvent so as to maximize the amount of bitumen or other carbonaceous liquid recovered and to minimize the fines content therein.

In this regard, it is well known in the art that solubility parameters can be used to predict the solvency power of solvents and that the solubility parameter of a solvent system can be changed by changing the composition of the solvent system. Mitchell and Speight, *Fuel,* 52, 149 (1973), explored the relationship between the solubility of asphaltenes in hydrocarbon solvents and the solubility parameters of such solvents. These authors point out that there is a tendency for petroleum asphaltenes to associate in dilute solutions and that the solvent power of petroleum hydrocarbons is generally not high enough to prevent association among the asphaltenes in crude oils to aggregate into micelles. Mitchell and Speight disclose that a prime requirement for a solvent to dissolve an oil, or bitumen, in toto is the ability to penetrate the asphaltene micelle and to have a high enough solvent power to dissolve asphaltenes.

The energy that must be supplied to overcome the association forces of the micelle is supplied by the solution energy of the solvent system. Mitchell and Speight state that the Hildebrand solubility parameter is a measure of the energy which may be used to overcome the forces of the micelle. Mitchell and Speight also disclose that asphaltene precipitation can be correlated with physical properties as well as with the chemical structure of the solvent and that their results show that the physical characteristics of two different solvent types are additive on a mole-fraction basis and suggest that, when bitumen is blended with a solvent, the degree of asphaltene precipitation in the solvent might be controlled by the properties of the resulting solvent-bitumen blend.

Moreover, Mitchell and Speight disclose that a further significant fact to emerge from their investigations is the distribution of mineral matter within the asphaltene precipitate. They find that, in a two-stage process involving precipitation by addition of solvent of part of the asphaltenes in the first stage and precipitation by addition of solvent of the remainder of the asphaltenes in a second stage, the majority of the mineral matter originally present in the bitumen appears in the first asphaltene fraction. Mitchell and Speight state that these findings suggest that mineral matter may be removed in conjunction with a fraction relatively enriched in hetero-atoms (nitrogen, oxygen and sulphur).

Similarly, G. Fritschy and E. Papirer, *Fuel,* 57 711 (1978) disclose that minerals, such as silica, alumina and kaolin, with surface hydroxyl groups, adsorb dissolved petroleum asphaltenes.

OBJECTS OF THE INVENTION

It is an object of the present invention to provide an improved extraction method for recovering bitumen from a carbonaceous solid and for removing fines from a carbonaceous liquid which permits control of the composition of the extraction solvent in order to attain a solvency power therefor which is predetermined to maximize the recovery of bitumen or other carbonaceous liquid and to minimize the fines content therein.

Other objects and advantages of the invention will become apparent upon reading the following detailed description and appended claims, and upon reference to the accompanying drawings.

SUMMARY OF THE INVENTION

The present invention is a method for removing solid fines in an extraction of bitumen from a carbonaceous solid or carbonaceous liquid containing extractable bitumen comprising: (a) forming a mixture comprising dissolved bitumen, up to about 25 weight % undissolved bitumen, solid sand fines, and solvent, wherein the undissolved up to about 25 weight % bitumen is sufficient to settle from the mixture and remove the solid sand fines; (b) permitting the undissolved bitumen to settle with at least a portion of the solid sand fines agglomerating and settling with the undissolved bitumen to form a lower solid phase; (c) separating an upper dissolved bitumen and solvent liquid phase from the lower solid phase; and (d) separating the dissolved bitumen from the solvent.

The advantage of forming a mixture comprising up to about 25 weight % undissolved bitumen is that this amount of bitumen agglomerates and removes sand fines to leave a reduced solids content bitumen solution. Surprisingly, the settling and removal of the sand fines by the undissolved bitumen occurs at unexpected high rates in excess of those predicted by specific gravity differences alone. The overall result is a fast continuous process resulting in a bitumen product of low solids content.

Two techniques for forming the desired mixture without requiring addition of a separate, deasphaltening solvent are used. Using one of these techniques, the method comprises:

(a) contacting tar sand with a solvent mixture having a Hildebrand solubility parameter between about 8.5 and about 10.5 to produce a bitumen laden solvent mixture, wherein the solvent mixture comprises at least one solvent with a Hildebrand solubility parameter higher than that of the bitumen and at least one solvent with a Hildebrand solubility parameter lower than that of the bitumen;

(b) separating sand from the bitumen laden solvent mixture;

(c) treating the bitumen laden solvent mixture to remove at least a portion of the higher solubility parameter solvent to precipitate an asphaltene fraction of the bitumen precipitated, and form a mixture comprising dissolved bitumen, undissolved asphaltenic bitumen, solid fines, and solvent;

(d) permitting the undissolved asphaltenic bitumen to settle with at least a portion of the solid fines agglomerating and settling with the undissolved asphaltenic bitumen;

(e) separating the settled asphaltenic bitumen and solid fines; and (f) stripping the solvent from the dissolved bitumen to produce product bitumen. This technique has the advantage that the asphaltene fraction precipitated to remove fines when the higher solubility parameter solvent is removed is a less valuable fraction than the asphaltene fraction which would be precipitated if the lower solubility parameter solvent were removed.

BRIEF DESCRIPTION OF THE DRAWINGS

For a more complete understanding of this invention, reference shall now be made to the embodiments illustrated in greater detail in the accompanying drawings and described below by way of examples of the invention. In the drawings.

It should be understood that the drawings are not to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not limited to the particular embodiments illustrated herein.

DETAILED DESCRIPTION OF THE DRAWINGS INCLUDING PREFERRED EMBODIMENTS

While in one respect the present invention is broadly a method for recovering bitumen from any carbonaceous solid containing extractable bitumen, and preferably from tar sand, diatomaceous earth or a solid containing heavy oil, only the recovery of bitumen from tar sand will be illustrated in detail.

Figure 1:
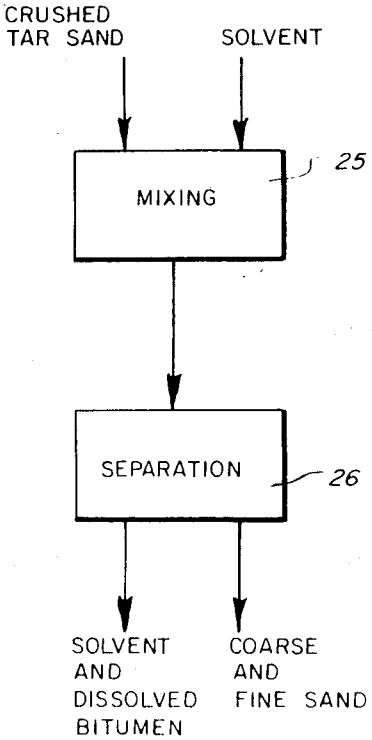
FIG. 1 is a schematic illustration of the processing steps in one embodiment of the method of this invention in which the extraction of bitumen from tar sand is followed by a single separation of both coarse and fine sand from the dissolved bitumen.

Referring now to FIG. 1 where one embodiment of the present invention is shown, crushed tar sand and a preselected solvent are brought into intimate contact in a mixing stage 25 where a predetermined portion of the bitumen content of the tar sand dissolves in the solvent, leaving a predetermined portion of the bitumen undissolved to form a slurry of dissolved bitumen, undissolved bitumen, spent sand, solid sand fines, and solvent. The resulting solid-liquid slurry is passed to a separation stage 26 where both the coarse and fine tar sand particles are separated from the solvent-dissolved bitumen liquid phase in a single stage.

In the separation stage 26, the coarse sand particles in the slurry fall immediately to the bottom and there form a solid phase, leaving the fine sand particles and undissolved bitumen suspended in the solvent-dissolved bitumen phase. The undissolved bitumen settles out of the solvent-dissolved bitumen liquid phase at a slower rate. Tar sand fines agglomerate with and settle with the undissolved bitumen to the bottom in the separation stage 26. Separation devices suitable for use in the separation stage 26 include a centrifuge, gravity settler or thickener. As will be discussed in greater detail hereinbelow, the solvent in the embodiment illustrated in FIG. 1 is selected to have a predetermined solvency or solvent power to dissolve most of the bitumen content of the crushed tar sand introduced but to leave undissolved a sufficient predetermined amount of the bitumen to form agglomerates with the suspended tar sand fines that are sufficiently large and dense to settle out of the solvent-dissolved bitumen liquid phase in the separator vessel 26. The solvent-dissolved bitumen liquid phase from which the agglomerated fines have settled is drawn off from the separator stage 26 as overflow. The solvent component of the overflow solvent-dissolved bitumen liquid phase is then stripped therefrom, affording bitumen as the final product.

Figure 2:
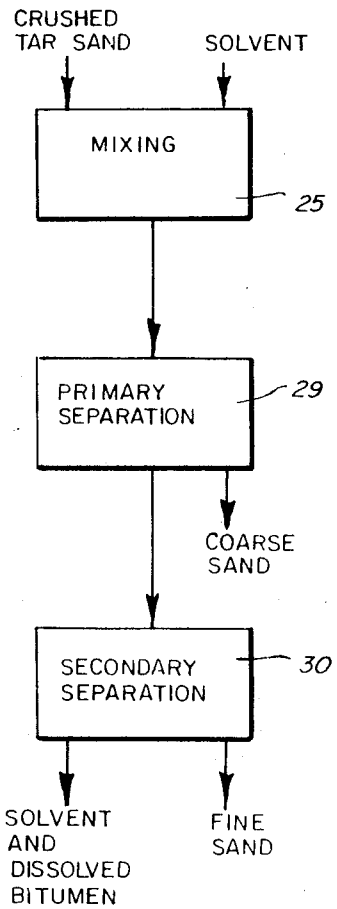
FIG. 2 is a schematic illustration of the processing steps in one embodiment of the method of this invention in which the extraction of bitumen from tar sand is followed by separate separations of the coarse and fine sand from the dissolved bitumen.

Turning now to FIG. 2, a preferred embodiment of the present invention comprises mixing crushed tar sand and solvent in a mixing stage to dissolve a predetermined portion of the bitumen content of the tar sand and leave undissolved a predetermined portion of the bitumen. The solid-liquid slurry from the mixing stage 25 passes to a primary separation stage 29 where the coarse sand particles immediately fall to the bottom, leaving fine sand particles and undissolved bitumen suspended in the solvent-dissolved bitumen liquid phase, which is then passed as overflow from the primary separation stage 29 to a secondary separation stage 30. The solvent power of the solvent system employed in the embodiment illustrated in FIG. 2 is predetermined as in the embodiment illustrated in FIG. 1 so that the sand fines agglomerate and settle out with the undissolved bitumen in the secondary separation stage 30 in FIG. 2 as described hereinabove with respect to the combined separation stage 26 in FIG. 1.

Any convenient conventional separation device which permits a separation of the coarse sand particles from the suspension of sand fines in the solvent-dissolved bitumen liquid phase before substantial settling of the agglomerated fines therefrom occurs can be employed in the primary separation stage 29. Thus, separation techniques which permit a rapid separation of the coarse sand particles from the solid-liquid slurry are generally suitable for this purpose. Separators suitable for use in the primary separation stage 29 include mechanical classifiers, large-diameter hydrocyclones or hydrosieves. The agglomerated fines are too small to be separated from the solvent-dissolved bitumen liquid phase in large-diameter hydrocyclones or mechanicals classifiers and pass with the liquid phase to the secondary separation stage 30. As in the combined separation stage 26 illustrated in FIG. 1, the secondary separation stage 30 entails settling of the agglomerated fines by gravity and typically employs for this purpose a centrifuge, gravity settler or thickener, or a hydrocyclone having a smaller diameter than a hydrocyclone that would be employed in the primary separation stage 29.

The primary advantage of the combination of the primary separation stage 29 and the secondary separation stage 30 in the embodiment illustrated in FIG. 2 over the single separation stage of the embodiment illustrated in FIG. 1 is that the primary separation stage 29 greatly reduces the solids loading in the secondary separation stage 30, thus affording improved separations of the agglomerated fines from the liquid phase in the secondary separation stage 30 and reduced size requirements for the separation devices employed in the secondary separation stage 30 by comparison to the separation stage 26.

Figure 3:
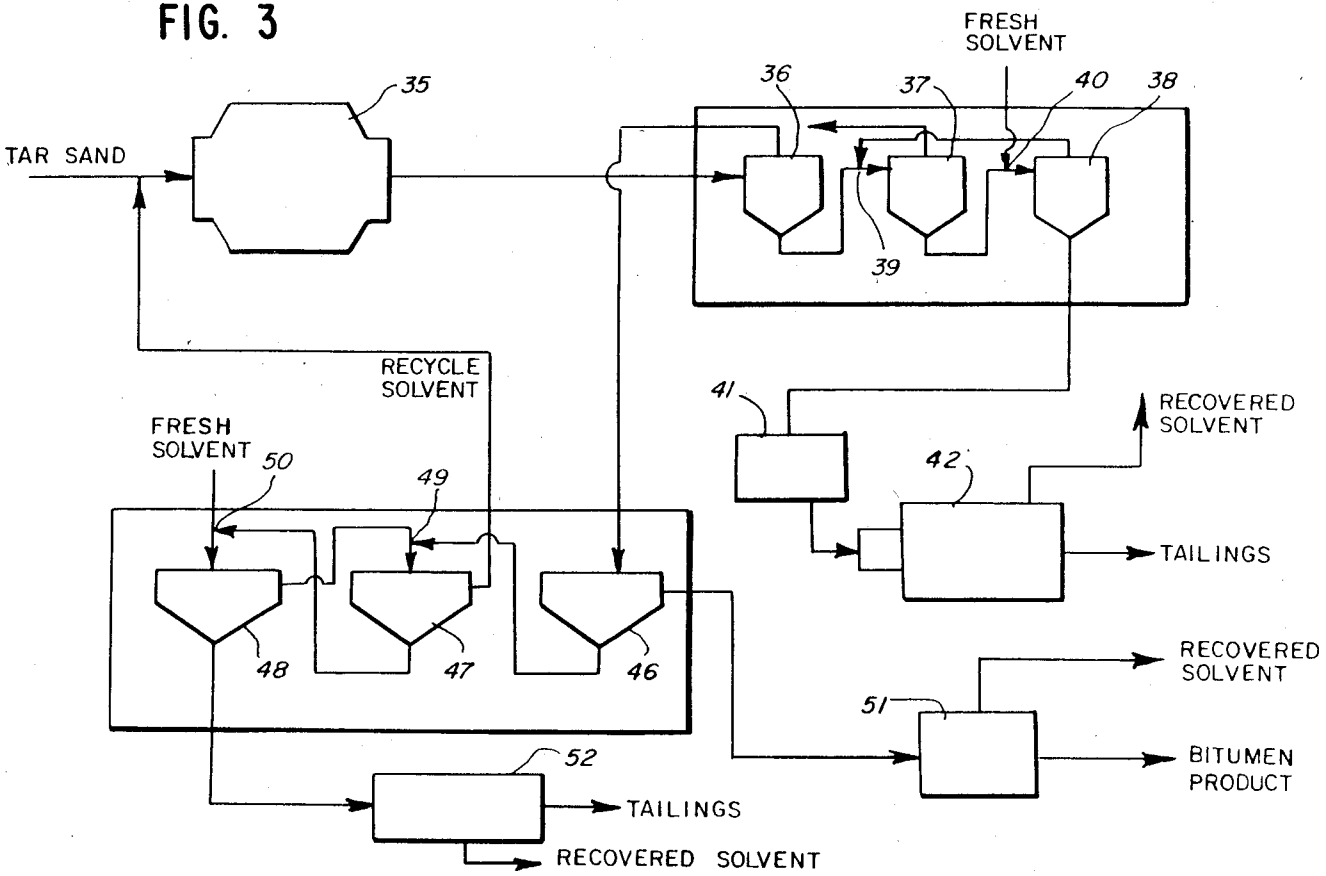
FIG. 3 is a schematic illustration of the processing steps and apparatus employed in a preferred embodiment of the method of this invention employing extraction of bitumen from tar sand, separate separations of the coarse and fine sand from the dissolved bitumen, treatment of both separated coarse and fine sand to recover bitumen and solvent entrained therein, and recycle of solvent.

A more preferred embodiment of the present invention is illustrated in FIG. 3. As shown in FIG. 3, crushed tar sand and recycled solvent are contacted in a mixer 35 where a portion of the bitumen content of the tar sand is dissolved in the solvent to form a solid-liquid slurry comprising coarse sand particles, sand fines, undissolved bitumen, and a solution of dissolved bitumen in the solvent. This slurry is passed to a series of hydrocyclones 36, 37 and 38 where the coarse sand particles are separated and then washed with fresh solvent. The hydrocyclone 36 serves to separate the coarse sand particles from the solid-liquid slurry from the mixer 35. The coarse sand particles are then withdrawn from the hydrocyclone 36 as underflow and combined and mixed with solvent at 39, and this mixture is introduced to the hydrocyclone 37 where the separated coarse sands are washed. Once-washed coarse sands are withdrawn from the hydrocyclone 37 as underflow and combined and mixed with fresh solvent at 40, and this mixture is introduced to the hydrocyclone 38 where the coarse sands are washed again. Twice-washed coarse sand is withdrawn from hydrocyclone 38 as underflow and passed to a filter 41 where solvent is filtered from the coarse particles. The filtered coarse particles are then dried in an evaporation drier 42 and the dried particles are stored or disposed as tailings.

The solid-liquid slurry containing fines and undissolved bitumen dispersed in a solution of dissolved bitumen in the solvent formed by the separation in the hydrocyclone 38 is withdrawn from the hydrocyclone 36 as overflow and introduced to the gravity settlers 46, 47 and 48 where agglomerated fines are separated and then washed. The settler 46 serves to separate the agglomerated fines from the solvent-dissolved bitumen liquid phase from the hydrocyclone 36. The agglomerated fines are withdrawn from the settler 46 as underflow and combined and mixed at 49 with overflow from the settler 48, and this mixture is introduced into the settler 47 where the agglomerated fines are washed. Once-washed agglomerated fines are withdrawn as underflow from the settler 47 and combined and mixed at 50 with fresh solvent, and this mixture is introduced to the settler 48 where the agglomerated fines are washed again. Twice-washed agglomerated fines are withdrawn as underflow from the settler 48. The washed agglomerated fines are then dried in the evaporation drier 52, and the dried fines are stored or disposed as tailings.

In another aspect, the present invention is a method for removing fines from a fines-containing carbonaceous liquid. While the method can be employed broadly with any carbonaceous liquid, and preferably bitumen, coal liquid, shale oil and heavy oil, only its application to bitumen from tar sand will be illustrated in detail. For example, bitumen extract produced from tar sand by a conventional extraction technique which employs a first solvent which dissolves the entire bitumen content of the tar sand generally has an unacceptably high content of suspended fines. After the bitumen is separated from the first solvent, the resulting bitumen is contacted in the method of the present invention with a second solvent which has a predetermined solvency power so as to dissolve a predetermined portion of the bitumen and to leave undissolved a predetermined portion of the bitumen that is sufficient to separate from the second solvent phase by settling. The aforesaid undissolved bitumen is then permitted to settle out, with at least a portion of the suspended fines agglomerating with and settling with the undissolved bitumen into the resulting lower agglomerate phase. After separating the upper solvent-dissolved bitumen liquid phase and lower agglomerate solid phase, the bitumen and second solvent are separated.

A critical element of the present invention in all of its aspects is the selection and use of a solvent having a predetermined solvency power so as to dissolve a predetermined portion of either (1) the bitumen content of the carbonaceous solid feed or (2) the carbonaceous liquid feed and to leave undissolved a sufficient portion of the bitumen or other carbonaceous liquid to settle out from the solvent-dissolved bitumen phase or solvent-other dissolved carbonaceous liquid phase.

While not intending to be limited by any theory or explanation for the method of this invention, it is believed that undissolved or precipitated components of the bitumen or other carbonaceous liquid, such as asphaltenes, coat the suspended fines. The coated fines are enlarged and destabilized by comparison to suspended fines that are not similarly coated and tend to enlarge further by sticking together and agglomerating upon additional contact with suspended fines and undissolved bitumen or other undissolved carbonaceous liquid.

The technique for selecting solvents for use in the present invention and the effect of variations in the solvency power of solvents on the reduction of the fines content of bitumen were illustrated using as feed bitumen compositions containing about 3 parts by weight of fine sand and one part by weight of bitumen on a solvent-free basis. Each of such feed compositions were obtained by extracting tar sand with toluene and decanting the resulting suspension of sand fines in the toluene-dissolved bitumen liquid phase from the coarse sand particles. Since toluene dissolves essentially all of the bitumen from the tar sand, insufficient undissolved bitumen remained suspended in the liquid phase to settle out, as required in the present invention. Consequently, in each case the toluene was removed by evaporation from the separated toluene-dissolved bitumen liquid phase. Each such composition was then mixed for about 15 minutes with one of a number of second solvent systems. In each case, the settling rate of the agglomerates was measured, and, after settling for 24 hours, the clarified product was decanted, and the sand fines were washed with another volume of clean second solvent to recover bitumen from the voids in the sand fines. Yields of dissolved or extracted bitumen and its content of sand fines were measured on a solvent free basis. The results of these experiments are summarized in FIGS. 4–8.

Each point in FIGS. 4–8 is identified by a number corresponding to the run from which the data plotted therein were obtained, and the following parameters for each such run are presented in Table I: fines concentration in weight percent in the bitumen feed composition used; solvent used and its volume average Hildebrand solubility parameter; and the volume ratio of solvent-to-bitumen feed composition. When a multi-component solvent was used, the volume fraction of each component of the solvent is indicated in Table I.

TABLE I

| Run No. | Feed Fine Level | Solvent | Solvent Solubility Parameter | Solvent-Feed Volume Ratio |
|---|---|---|---|---|
| 1 | 75 | toluene-0.20<br>n-pentane-0.80 | 7.38 | 11.7 |
| 2 | 75 | toluene-0.10<br>n-pentane-0.90 | 7.19 | 12.5 |
| 3 | 75 | toluene-0.046<br>n-pentane-0.954 | 7.09 | 13.7 |
| 4 | 74 | $CFCl_3$-0.50<br>n-pentane-0.50 | 7.30 | 11.4 |
| 5 | 74 | $CFCl_3$-0.20<br>n-pentane-0.80 | 7.12 | 9.4 |
| 6 | 70 | $CFCl_3$-0.046<br>n-pentane-0.954 | 7.03 | 10.3 |
| 7 | 78 | $CFCl_3$-0.30<br>n-pentane-0.70 | 7.18 | 14.9 |
| 8 | 77 | $CFCl_3$-0.20<br>n-pentane-0.80 | 7.12 | 16.2 |
| 9 | 76 | toluene-1.00 | 8.9 | 15.8 |
| 10 | 72 | toluene-0.076<br>n-pentane-0.924 | 7.15 | 11.4 |
| 11 | 71 | toluene-0.10<br>n-pentane-0.90 | 7.19 | 10.2 |
| 12 | 71 | toluene-0.10<br>n-pentane-0.90 | 7.19 | 7.26 |
| 13 | 70 | toluene-0.10<br>n-pentane-0.90 | 7.19 | 5.21 |
| 14 | 71 | toluene-0.10<br>n-pentane-0.90 | 7.19 | 20.1 |
| 15 | 69 | toluene-0.10<br>n-pentane-0.90 | 7.19 | 3.04 |
| 16 | 70 | n-hexane-1.00 | 7.3 | 10.2 |
| 17 | 71 | toluene-0.10<br>n-pentane-0.90 | 7.19 | 10.3 |
| 18 | 73 | toluene-0.10<br>n-pentane-0.90 | 7.19 | 11.0 |
| 19 | 71 | n-pentane-1.00 | 7.0 | 7.6 |
| 20 | 72 | n-pentane-1.00 | 7.0 | 5.25 |
| 21 | 72 | toluene-0.10<br>n-pentane-0.90 | 7.19 | 10.6 |
| 22 | 71 | n-pentane-1.00 | 7.0 | 7.34 |
| 23 | 71 | n-pentane-1.00 | 7.0 | 10.8 |
| 24 | 69 | $CH_2Cl_2$-0.42<br>i-pentane-0.58 | 8.0 | 10.7 |
| 25 | 72 | 3-methylpentane-1.00 | 7.13 | 10.7 |
| 26 | 73 | cyclohexane-0.17<br>n-pentane-0.83 | 7.20 | 10.9 |

Figure 4:
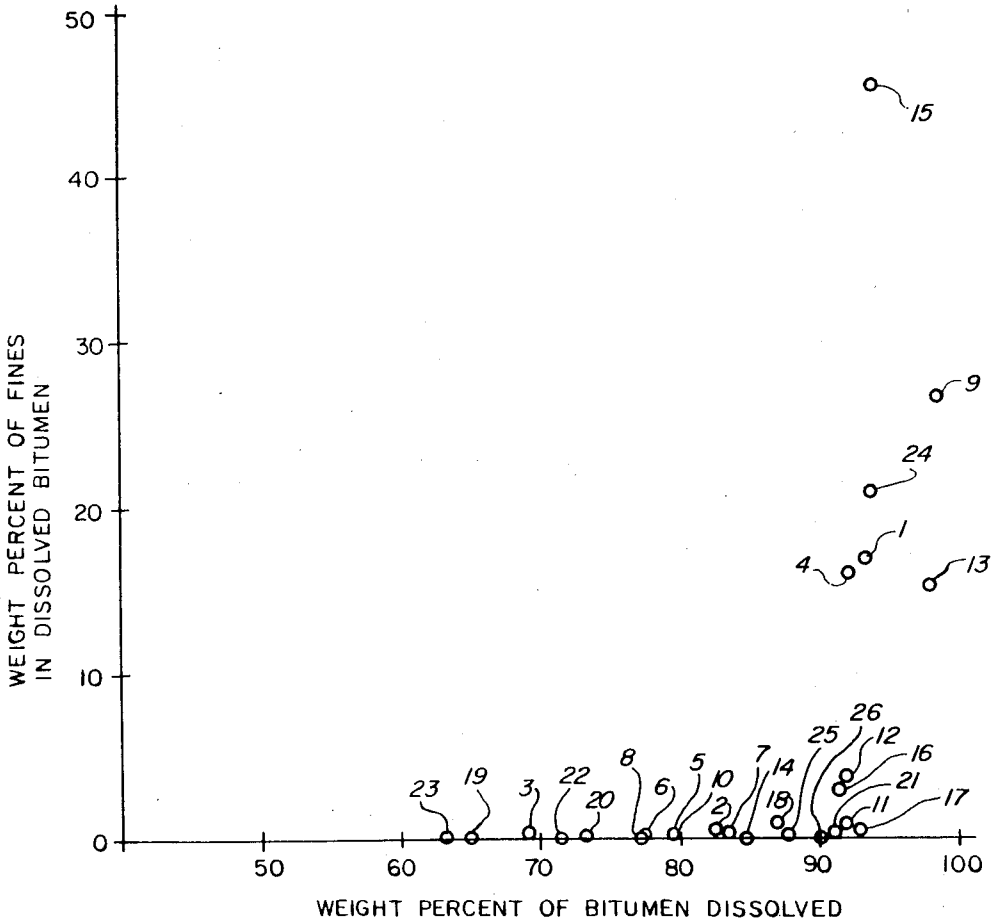
FIG. 4 is a plot of the weight percent of the bitumen content of tar sand that is recovered by extraction according to one embodiment of the method of this invention versus the weight percent of fines in such recovered bitumen.

As indicated in FIG. 4, when the weight percent of the bitumen content of the tar sand that was dissolved in the extraction solvent was 90 or less, the weight percent of fines in the recovered dissolved bitumen was less than or equal to 1 weight percent. The level of fines in the solution of dissolved bitumen generally was not reduced below 0.5 weight percent regardless of how much below 90 weight percent the yield of dissolved bitumen was reduced. However, above a 90 weight percent yield of dissolved bitumen, the levels of fines in the solution of dissolved bitumen increased dramatically.

Figure 5:
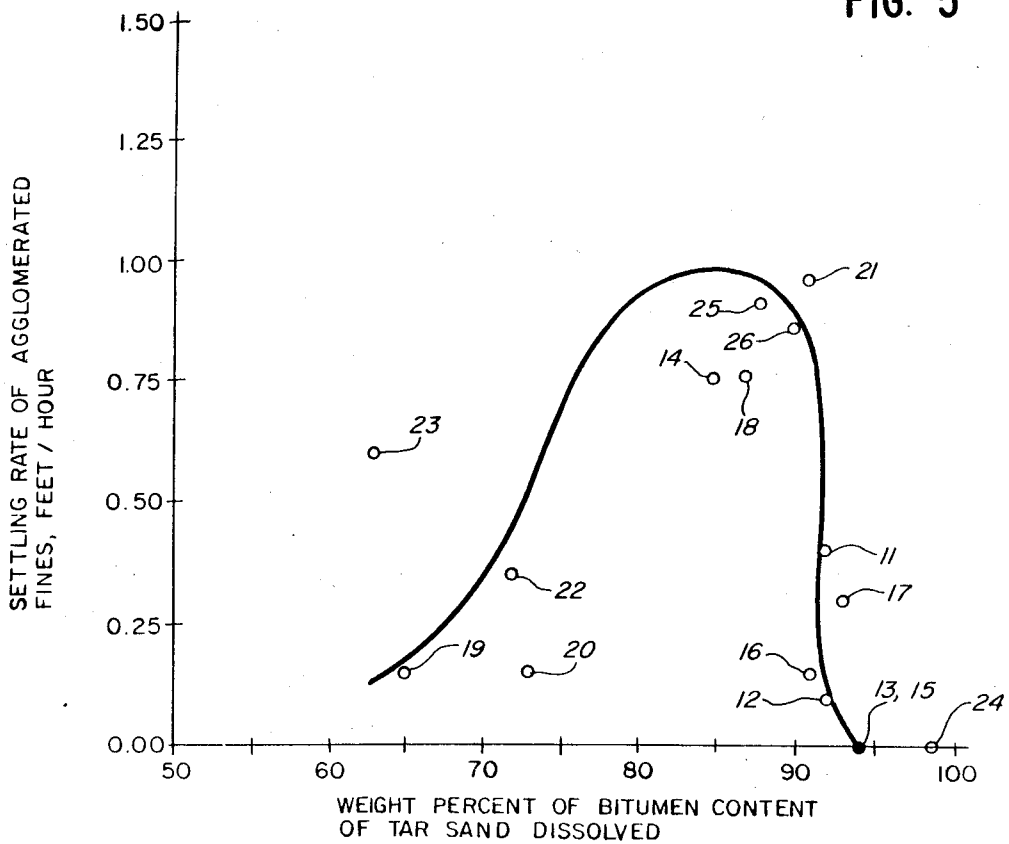
FIG. 5 is a plot of the rate of settling of the agglomerated fines from the extract resulting from an extraction of tar sand in one embodiment of the method of this invention, versus the weight percent of the bitumen content of the tar sand that is recovered by the extraction.

FIG. 5 illustrates that the variation of the settling rate as a function of the weight percent of the bitumen content of the tar sand that was dissolved in the extraction solvent passes through a maximum. While not intending to be bound or limited by any theory or explanation for this behavior, it is believed that, when the yield of dissolved bitumen exceeds the yield therefor where the maximum settling rate occurs, too little of the bitumen remains undissolved to settle out, and, when the yield of dissolved bitumen becomes less than the yield therefor where the maximum settling rate occurs, the density of the agglomerates decreases and their volume fraction increases, both of which reduce the settling rate.

As seen in FIG. 5, unexpected increases in the settling rate occurred when about 7 to about 15 wt. % of the bitumen from Sunnyside tar sand was left undissolved. With other tar sands the high settling rates can occur over a broader % range of undissolved bitumen. These increases are greater than that predicted from density differences using Stoke's Law. For example, Run 18 shows a six-fold increase in settling rate over Run 16, yet the solvent density difference is only 10–15% greater.

From the correlations shown in FIGS. 4–5, it is evident that the availability of a method for predetermining the percent weight of bitumen or other carbonaceous liquid that would be dissolved (or not be dissolved) by a solvent system—or in other words, for predetermining the solvency power of the solvent for the bitumen or other carbonaceous liquid—would permit the design of extractions which would afford a high yield of dissolved bitumen or other carbonaceous liquid having a low fines content.

Mitchell and Speight found a negative linear relationship between the fraction of bitumen precipitated by a solvent and the Hildebrand solubility parameter of that solvent. By contrast, I have found that the yield of dissolved bitumen or other dissolved carbonaceous liquid is a function of the volume average Hildebrand solubility parameter of the total solvent-dissolved bitumen liquid phase or solvent-dissolved other carbonaceous liquid phase formed in the extraction. The average Hildebrand solubility parameter of this total liquid phase is the volume average of the Hildebrand solubility parameters of each of the liquids present, including the dissolved bitumen or other dissolved carbonaceous liquid. Thus, to predict the solubility of bitumen or other carbonaceous liquid, the Hildebrand solubility parameter for the dissolved bitumen or for the other dissolved carbonaceous liquid must itself be known.

The average Hildebrand solubility parameter for a solvent blend comprised of several component solvents, each of whose Hildebrand solubility parameters is known, is simply the volumetric average of the Hildebrand solubility parameters of each of the several components of the blend. The Hildebrand solubility parameters of many typical solvents have been published. However, typically components of the dissolved bitumen or other dissolved carbonaceous liquid are not identified, and, in addition, the Hildebrand solubility parameters of some components of such dissolved liquids may not be known. Consequently, the value for the Hildebrand solubility parameter for the dissolved bitumen or other dissolved carbonaceous liquid must be determined experimentally.

Figure 6:
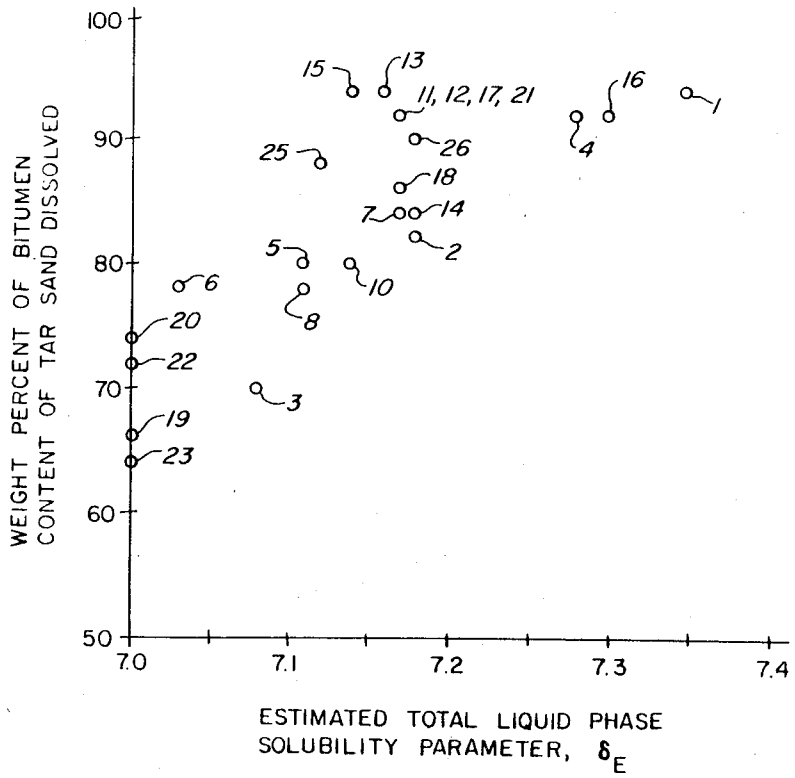
FIG. 6 is a plot of the weight percent of the bitumen content of tar sand that is recovered by extraction according to one embodiment of the method of this invention, versus the estimated volume average Hildebrand solubility parameter of the solvent-dissolved bitumen liquid phase resulting from the extraction, assuming a volume average Hildebrand solubility parameter for the dissolved bitumen of 7.0.
Figure 7:
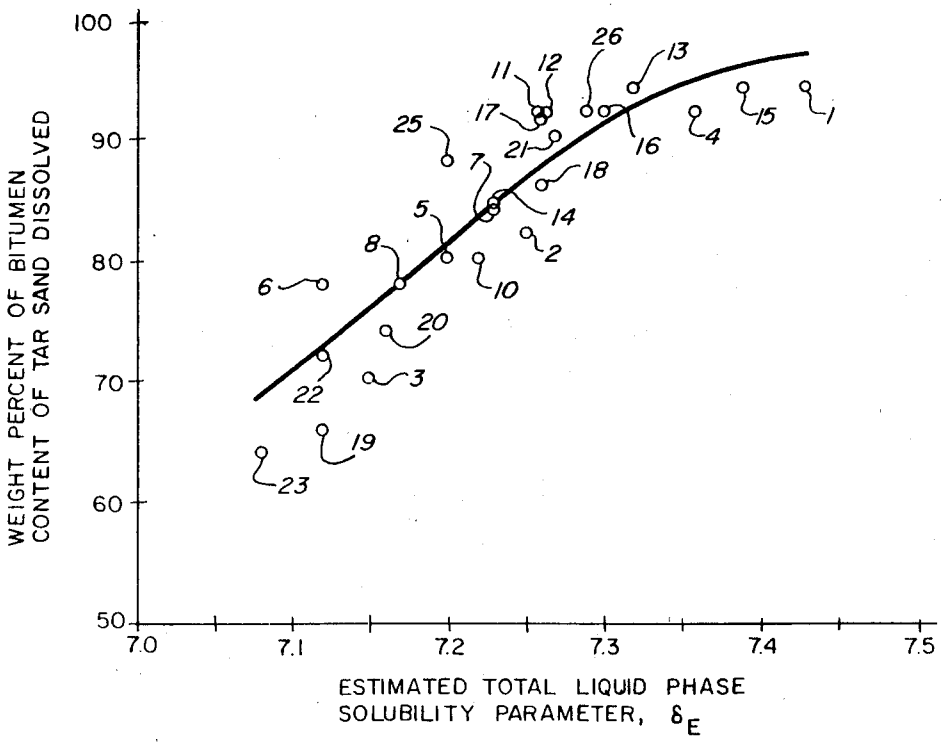
FIG. 7 is a plot of the weight percent of the bitumen content of tar sand that is recovered by extraction according to one embodiment of the method of this invention, versus the estimated volume average Hildebrand solubility parameter of the solvent-dissolved bitumen liquid phase resulting from the extraction, assuming a volume average Hildebrand solubility parameter for the dissolved bitumen of 8.0.
Figure 8:
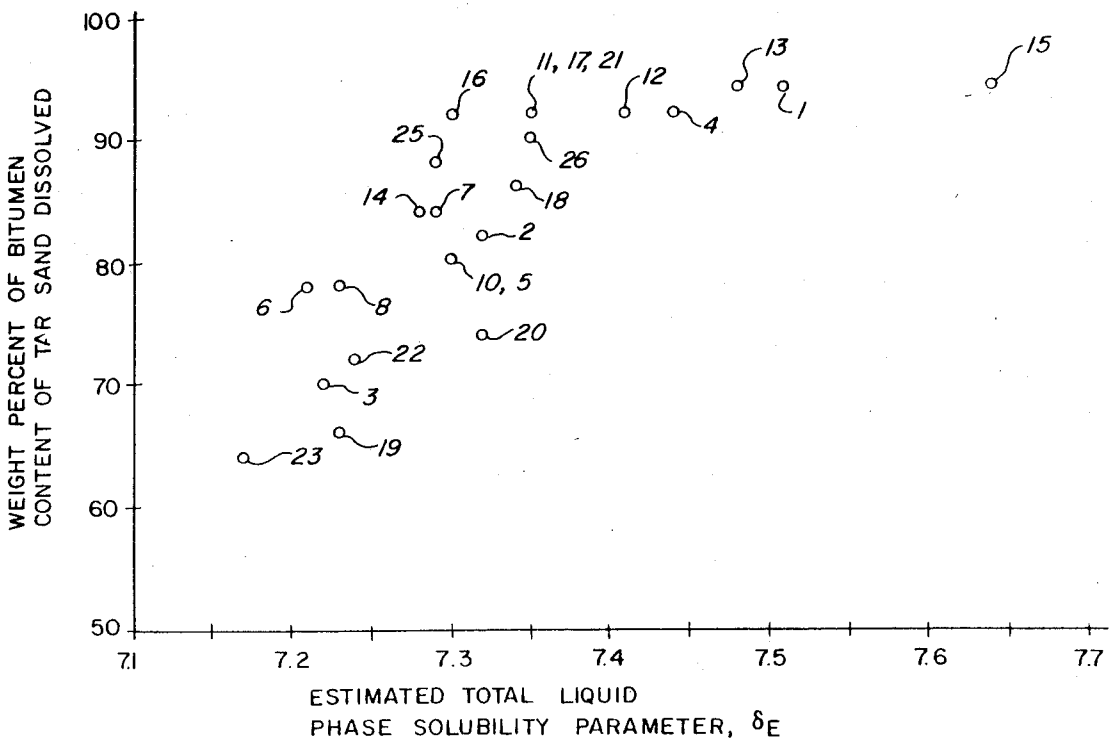
FIG. 8 is a plot of the weight percent of the bitumen content of tar sand that is recovered by extraction according to one embodiment of the method of this invention, versus the estimated volume average Hildebrand solubility parameter of the solvent-dissolved bitumen liquid phase resulting from the extraction, assuming a volume average Hildebrand solubility parameter for the dissolved bitumen of 9.0.

This is easily done by extracting the carbonaceous solid feed or carbonaceous liquid feed with different solvents and with different relative amounts thereof and measuring the amount of dissolved bitumen or other dissolved carbonaceous liquid in each case. A plot is then made of the weight percent of the bitumen content of the carbonaceous solid feed or weight percent of the carbonaceous liquid feed that is dissolved, versus the estimated volume average Hildebrand solubility parameter, $\delta_E$ of the solvent-dissolved bitumen liquid phase or solvent-other dissolved carbonaceous liquid phase, as shown in FIGS. 6–8. The estimated volume average Hildebrand solubility parameter of the solvent-dissolved bitumen or solvent- other dissolved carbonaceous liquid phase is determined, for example, with a one-component solvent or a 2-component solvent, using Equations 1 or 2, respectively, as follows:

$$\delta_E = \frac{\delta_B V_B + \delta_{S1} V_{S1}}{V_B + V_{S1}} \quad (1)$$

$$\delta_E = \frac{\delta_B V_B + \delta_{S1} V_{S1} + \delta_{S2} V_{S2}}{V_B + V_{S1} + V_{S2}} \quad (2)$$

wherein $\delta_B$, $\delta_{S1}$ and $\delta_{S2}$ are the Hildebrand solubility parameters of the dissolved bitumen or other dissolved carbonaceous liquid, of the first or only component of the solvent, and of the second component (if present) of the solvent, respectively. $V_B$, $V_{S1}$ and $V_{S2}$ are the volumes of the dissolved bitumen or other dissolved carbonaceous liquid, of the first or only component of the solvent and of the second component (if any) of the solvent, respectively. Since $\delta_{S1}$, $\delta_{S2}$, $V_B$, $V_{S1}$ and $V_{S2}$ are known or measured, $\delta_E$ can be calculated by assuming a value for $\delta_B$. The correct $\delta_B$ is that value of $\delta_B$ which gives the best correlation between the yield of dissolved bitumen or other dissolved carbonaceous liquid and $\delta_E$ when plotted as in FIGS. 6–8.

An example of the determination of $\delta_B$ is shown in FIGS. 6–8. In FIGS. 6–8, the value of $\delta_E$, the x-coordinate, for each point was determined using Equation 1 or 2 hereinabove and the measured or known values of $\delta_{S1}$, $V_{S1}$, $\delta_{S2}$, $V_{S2}$ and $V_B$, and assuming a value of $\delta_B$. For the data plotted in FIGS. 6–8, $\delta_B$ was assumed to be 7.0, 8.0 and 9.0, respectively. The plot shown in FIG. 7 demonstrates the best correlation between the yield of dissolved bitumen and $\delta_E$. This correlation is shown by the curve in FIG. 7.

Thus, from plots like those shown in FIGS. 4–5, one can predetermine the yield of dissolved bitumen or other dissolved carbonaceous liquid—and conversely the yield of undissolved bitumen or other carbonaceous liquid—which is necessary to afford the desired predetermined settling rate and content of sand fines in the dissolved bitumen or other dissolved carbonaceous liquid. Then, from this predetermined yield of dissolved bitumen or other dissolved carbonaceous liquid and from plots like those shown in FIGS. 6–8, one can determine the average solubility parameter of the dissolved bitumen or other dissolved carbonaceous liquid, and can predetermine the volume average Hildebrand solubility parameters of the solvent-dissolved bitumen liquid phase or of the solvent-other dissolved carbonaceous liquid phase, which is necessary to afford the desired predetermined settling rate and content of sand fines in the dissolved bitumen or other dissolved carbonaceous liquid.

Finally, from these predetermined volume average Hildebrand solubility parameters of the dissolved bitumen or other dissolved carbonaceous liquid and of the solvent-dissolved bitumen liquid phase or solvent- other dissolved carbonaceous liquid phase and from equations like Equation 1 or 2, one can predetermine the volume of solvent and the Hildebrand solubility parameter of the one-component solvent or volume average Hildebrand solubility parameter of the multi-component solvent which is necessary to afford the desired predetermined settling rate and content of sand fines in the dissolved bitumen or other dissolved carbonaceous liquid.

As shown by the plot in FIG. 7, the weight percent of the bitumen or other carbonaceous liquid that is dissolved in a solvent increases as the solubility parameter of the solvent-dissolved bitumen liquid phase or solvent-other dissolved carbonaceous liquid phase increases. However, although not shown in FIG. 7, as the solubility parameter of the solvent increases further, the weight percent of the bitumen or other carbonaceous liquid that is dissolved in a solvent passes through a maximum and then decreases. Thus, in order to effect dissolution of a particular weight percent of the bitumen or other carbonaceous liquid and minimize the fines content of the resulting solution, suitable solubility parameters on both sides of the aforesaid maximum can be selected.

After the volume average solubility parameter of a desirable solvent system is determined, the choice of a suitable solvent system is simply a function of the cost and availability of either relatively pure solvents or blends of solvents, such as refinery streams, which either have suitable solubility parameters or can be blended with other available components or streams to afford a blend which does have a suitable solubility parameter. In addition, it is possible to remove a component from a readily available blend of solvents such as a refinery stream and thereby to produce a new stream having a more desirable solubility parameter than the original.

Furthermore, it will be evident to those skilled in the art that plots like those shown in FIGS. 6–8 can be used not only to select a solvent for use in an extraction of a fines-containing carbonaceous liquid as in Runs 1–26, but also to select a solvent for use in an extraction of a carbonaceous solid. For example, in an extraction from tar sand of soluble bitumen of the same type used as feed in Runs 1–26, the dissolved bitumen would also have a Hildebrand solubility parameter of 8.0. From the correlation shown in FIG. 7, the volume average Hildebrand solubility parameter of a solvent-dissolved bitumen total liquid phase having a high yield of dissolved bitumen and a low fines content could suitably be 7.29. To achieve a solubility parameter of 7.29 for a solution containing 20 parts of solvent and 1 part by volume of the aforesaid dissolved bitumen having a solubility parameter of 8.0, a solvent system having an average solubility parameter of 7.25 should be employed. A solvent blend of 35 volume percent of commercial heptane and 65 volume percent of n-pentane does have a volume average Hildebrand solubility parameter of 7.25. Consequently, 20 parts by volume of the aforesaid blend of heptane and n-pentane were employed to extract 1 part by volume of the bitumen from the aforesaid tar sand. The resulting solution contained as dissolved bitumen 90 weight percent of the bitumen content of the tar sand which had a 0.23 percent by weight concentration of fines. The agglomerated fines settled out at 0.67 foot per hour.

It will of course be recognized that, while the Hildebrand solubility parameter has been employed in the work reported hereinabove and is probably the solubility parameter that is best known and most widely used by those skilled in the art, the present invention does not require the use of the Hildebrand solubility parameter, and any reported measure of the solvency or solvent power of a solvent can be employed in practicing the present method. Furthermore, although the method illustrated in FIGS. 4–8 and the related discussion hereinabove is preferred for determining solubility parameters for the dissolved bitumen or other dissolved carbonaceous liquid and for the solvent-dissolved bitumen liquid phase or other solvent-dissolved carbonaceous liquid phase, any other convenient method for so doing can be employed. For example, E. W. Funk, Ind. Eng. Chem., Prod. Res. Deo., Vol. 16, No. 2, pages 115–120, 1977, discloses another method for determining solubility parameters.

The solvent system employed in the present invention can be selected from among a very large number of single- and multi-component solvents, and the selection in any particular case is limited solely by the solubility parameter described and the cost and availability of solvents having the desired solubility parameter. A suitable solvent comprises at least one nonpolar hydrocarbon which is unsubstituted or substituted by at least one halogen, oxygen, nitrogen or sulfur atom and has from 1 to 15 carbon atoms. Typical solvents include n-butane; methyl and dimethyl butane; n-pentane; n-hexane; n-heptane; n-octane, methyl, ethyl, dimethyl and trimethyl pentanes, hexanes, heptanes and octanes; cyclopentane; cyclohexane; methyl cyclopentane and cyclohexane; benzene; toluene; the xylenes; acetones; methylethylketone, methanol, ethanol, the propanols, the butanols; methyl ether; ethyl ether; methylethylether; the halogenated derivatives of any of these; and mixtures of any of the aforementioned. The hydrocarbon has preferably from 1 to 7 carbon atoms and more preferably from 4 to 7 carbon atoms.

The solvent employed in the present invention is selected to have a solvency power that is predetermined preferably to dissolve at least 75 weight percent of the bitumen or other carbonaceous liquid in the feed and to leave undissolved from 7 to 25 weight percent, more preferably from 7 to 15 weight percent, of the bitumen or other carbonaceous liquid in the feed. The undissolved bitumen or other carbonaceous liquid and agglomerated fines settle out preferably at a predetermined rate, more preferably at a rate of at least 0.1 foot per hour, and most preferably at a rate of at least 1 foot per hour. Preferably the bitumen product or other carbonaceous liquid product of the method of this invention contains less than about 2 weight percent of fines or ash.

Figure 9:
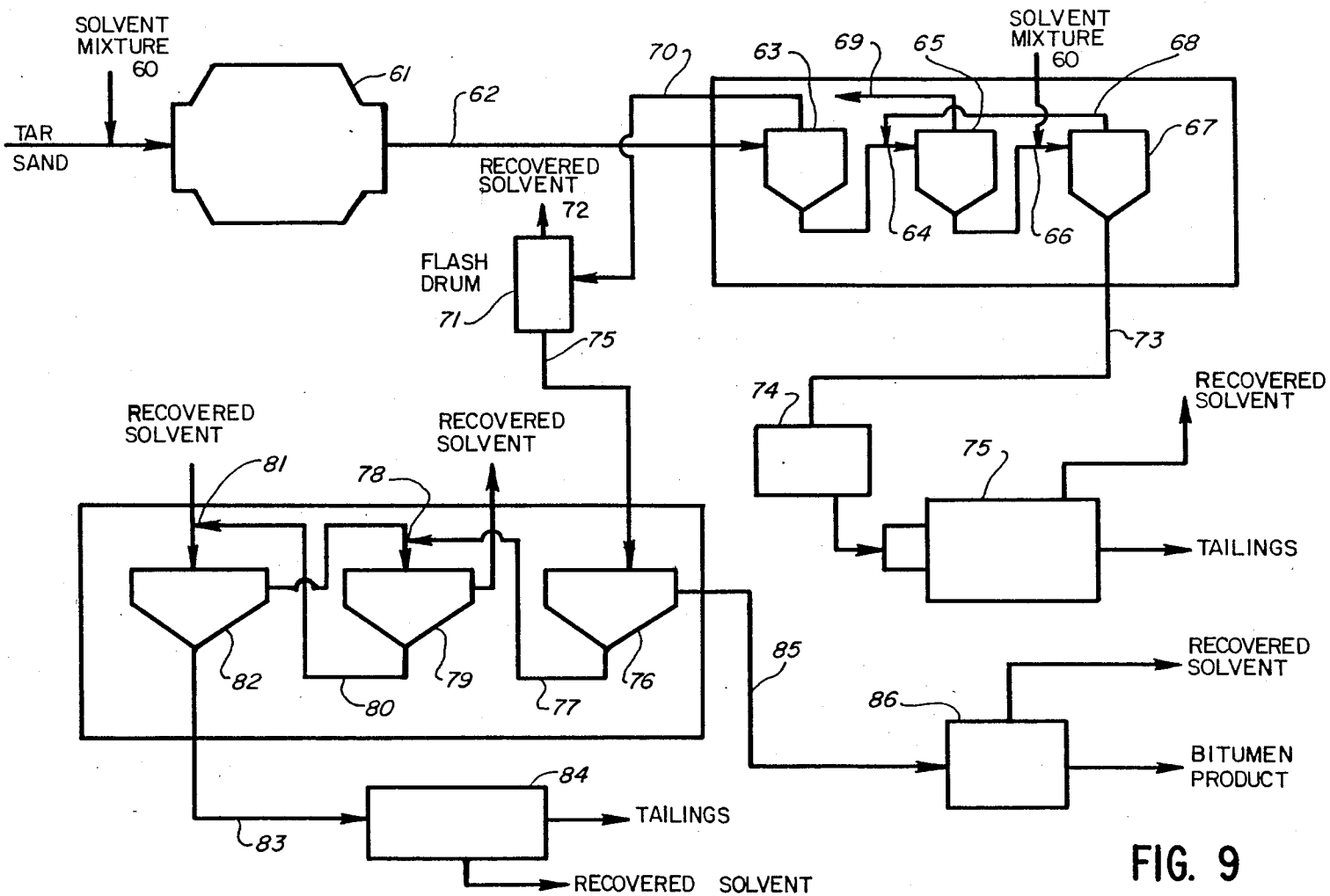
FIG. 9 is a schematic illustration of the processing steps and apparatus employed in another aspect of the invention.

FIG. 3 illustrates one technique for forming a mixture comprising dissolved bitumen, about 7 to about 25 weight % undissolved bitumen, solid sand fines and solvent wherein the solvent has a solvency power which dissolves a portion of the bitumen in the solvent and leaves about 7 to about 25 weight % undissolved bitumen which is sufficient to settle from the mixture and remove the solid sand fines; permitting the undissolved bitumen to settle with at least a portion of the solid fines agglomerating and settling with the undissolved bitumen to form a lower solid phase; separating an upper dissolved bitumen and solvent liquid phase from the lower solid phase and separating the dissolved bitumen from the solvent liquid phase. In FIG. 3 the mixture containing undissolved bitumen is formed upon contacting the tar sand with the solvent, because the solvent is predetermined to leave undissolved the sufficient amount of bitumen. Co-pending Application Ser. No. 449,607 is directed to this technique. FIG. 9 on the other hand illustrates another technique for forming the mixture containing sufficient undissolved bitumen to agglomerate the sand fines, wherein the mixture is formed upon removal of a portion of solvent from a solution of solvent, dissolved bitumen, and fine sand. Significantly, in both techniques, the mixtures comprising sufficient undissolved bitumen is not formed by the addition of a separate solvent, such as a de-asphaltening solvent which precipitates asphaltenes upon its addition.

In FIG. 9 tar sand is shown mixed with solvent 60 in mixer 61. The solvent is designed to substantially dissolve all of the bitumen in the tar sand without leaving an undissolved portion of the bitumen as in the process of FIG. 3. The solvent 60 is of a nature such that when a portion of the solvent is removed from a solution of the solvent, dissolved bitumen, and sand particles, the solvency power of the solution changes and the desired amount of the dissolved bitumen precipitates. To accomplish this, the solvent 60 is preferably a mixture comprising at least two hydrocarbon solvents and has a Hildebrand solubility parameter of about 8.5 to about 10.5. One of the hydrocarbons has a Hildebrand solubility higher than that of the bitumen, or about 9 to about 11, and the other has a Hildebrand solubility parameter lower than that of bitumen, or about 7 to about 8.

The dissolved bitumen in solvent, coarse sand, and sand fines slurry is sent through line 62 to a series of hydrocyclones 63, 65, and 67 where the coarse sand is separated and washed. Hydrocyclone 63 separates underflow 64 containing coarse sand which is combined at 64 with solvent from overflow 68 of hydrocyclone 67 and sent to hydrocyclone 65. The overflow 69 of cyclone 65 is mainly solvent and is used for make-up purposes. Once-washed coarse sands are withdrawn from the hydrocyclone 65 as underflow and combined and mixed with fresh solvent mixture 60 at 66, and this mixture is introduced to the hydrocyclone 67 where the coarse sands are washed again. Twice-washed coarse sand is withdrawn from hydrocyclone 67 as underflow 73 and passed to a filter 74 where solvent is filtered from the coarse particles. The filtered coarse particles are then dried in an evaporation drier 75 and the dried particles are stored or disposed as tailings.

The overflow 70 from hydrocyclone 63 contains dissolved bitumen, solid particle fines, and solvent, and is sent to flash drum 71. In flash drum 71 a portion of the solvent is removed to precipitate a sufficient amount of asphaltenic bitumen to agglomerate and separate the solid fines. Recovered solvent 72 is used to remake additional solvent 60 and as a wash stream in settler 82. The stream 75 exiting the flash drum contains the mixture comprising dissolved bitumen, undissolved bitumen sufficient to settle and agglomerate solid fine particles the solid particle fines, and solvent. It is then sent to gravity settlers 76, 79 and 82 where the agglomerated particles fines are settled, separated and then washed. Settler 76 serves to separate the agglomerated fines from the solvent dissolved bitumen liquid phase 75 from flash drum 71. The agglomerated fines are withdrawn from the settler 76 as underflow 77 and combined and mixed at 78 with overflow from the settler 82, and this mixture is introduced into the settler 79 where the agglomerated fines are washed. Once wash agglomerated fines are withdrawn as underflow 80 from the settler 79 and combined and mixed at 81 with recovered solvent 72, and this mixture is introduced to the settler 82 where the agglomerated fines are washed again. Twice washed agglomerated fines are withdrawn as underflow 83 from the settler 82. The washed agglomerated fines are then dried in evaporation dryer 84 and the dried fines are stored or disposed as tailings. The overflow 85 from settler 76 contains the dissolved bitumen solvent liquid phase and is sent to evaporator 86 wherein the solvent is recovered and the product bitumen is separated.

As discussed above, the purpose of the flash drum or other solvent removal device is to remove at least a portion of the solvent so that sufficient dissolved bitumen is precipitated from the remaining solvent bitumen solution to settle and agglomerate the sand particle fines. To accomplish this, the solvent 60 is a multi-component solvent mixture having a Hildebrand solubility parameter between about 8.5 and about 10.5, comprising at least one solvent with a Hildebrand solubility parameter higher than that of bitumen and at least one solvent with a Hildebrand solubility parameter lower than that of bitumen. The flash drum 71 permits easy separation of sufficient asphaltenic bitumen to settle and agglomerate the fines because at least a portion of one of the solvent components of such a solvent mixture is removed by control of the conditions in the flash drum, thereby changing the solubility power of the solvent bitumen solution. The conditions in the flash drum are controlled so that about 7 to about 25 weight % of the bitumen, preferably about 7 to about 15%, and more preferably about 10 weight % of the bitumen precipitates.

It is preferred to maintain the flash drum under conditions so that at least a portion or substantially all of the higher solubility parameter solvent is removed while leaving the lower solubility parameter solvent. This is preferred because the asphaltenes which are soluble in the higher solubility parameter solvent are less valuable than those which are soluble in the lower solubility parameter solvent and are thus preferably removed.

Thus in a further aspect, the method comprises contacting a bitumen containing carbonaceous solid such as tar sand or a carbonaceous liquid with a solvent mixture having a solubility parameter between about 8.5 and about 10.5 to produce a bitumen laden solvent mixture, wherein the solvent mixture comprises at least one solvent with a Hildebrand solubility parameter higher than that of the bitumen and at least one solvent with a Hildebrand solubility parameter lower than that of the bitumen; separating coarse sand from the bitumen laden solvent mixture; treating the bitumen laden solvent mixture to remove at least a portion of the higher Hildebrand solubility parameter solvent so that an asphaltene fraction of the bitumen is precipitated from the remaining solvent solution to form a mixture comprising dissolved bitumen, undissolved asphaltenic bitumen, solid fines and solvent in which the lower solubility parameter solvent is relatively more concentrated; permitting the undissolved asphaltenic bitumen to settle with at least a portion of the solid fines agglomerating and settling with the undissolved asphaltenic bitumen; separating agglomerated undissolved asphaltenic bitumen and solid fines; and stripping the solvent from the dissolved bitumen to produce bitumen.

In the removal of one of the solvents from the bitumen laden solvent mixture to precipitate sufficient bitumen to agglomerate and settle the solid fines, sufficient solvent is removed to change the solvency power of the solution and precipitate about 7 to about 25 weight % of the asphaltene content of the bitumen. This amount of undissolved bitumen is sufficient to agglomerate and settle the fines. A preferred range is to precipitate about 7 to about 15 weight % bitumen because below 7% is insufficient for effective fines agglomeration and removal while above 15% does not improve the fines removal significantly. More preferred is to precipitate about 10 weight % of the asphaltenes because it results in lower fine content with higher recovery of bitumen. As noted above, about 7 to 15 wt.% undissolved bitumen achieved unexpected increases in settling rates in tests simulating the process of FIG. 3 with Sunnyside, Utah tar sands. This behaviour also occurs when the mixture containing undissolved bitumen is formed according to the process of FIG. 9.

The desired amount of asphaltenes can be precipitated when a flash drum is operated to produce a Hildebrand solubility parameter of about 7 to about 8 or about 9 to about 11 in the resulting mixture 73. It is preferred, however, to flash off at least a portion of the high solubility parameter solvent so that the solubility parameter in the mixture 73 is about 7 to about 8.

To formulate the solvent mixture 60, the solvents named above are used. The solvent mixture 60 is formulated with at least two components so that substantially all of the bitumen in the tar sand feed is initially dissolved. Useful lower solubility parameter solvents include, for example, Freon-11, ($CFCl_3$) Freon-113, naptha, kerosine, paraffinic or olefinic hydrocarbons of carbon number 3 through 12, and mixtures thereof, and preferably paraffinic hydrocarbons of carbon number 8 to 12 because they are strong solvents of lower volatility. Lower volatility and boiling point are preferred for the lower solubility parameter component to aid in operating the flash drum to remove the higher solubility parameter component. The component of the solvent mixture having a solubility parameter higher than that of bitumen includes, for example, toluene, benzene, chloro- and nitrobenzene, furan, dimethyl sulfide, carbon disulfide, triophene, pyridine, ketones of carbon number 5 or less, alcohols of carbon number 4 or less, chlorinated compounds of carbon number two or less, such as methylene chloride, and mixtures thereof.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

Having described the invention, what is claimed is:

1. A method for removing solid fines in an extraction of bitumen from a carbonaceous solid or carbonaceous liquid containing extractable bitumen comprising:

(a) forming a mixture comprising dissolved bitumen, about 5 to about 25 weight % undissolved bitumen, solid particle fines, and solvent wherein the about 5 to about 25 weight % undissolved bitumen is sufficient to settle from the mixture and remove the solid particle fines;

(b) permitting the undissolved bitumen to settle with at least a portion of the solid fines agglomerating and settling with the undissolved bitumen to form a lower solid phase;

(c) separating an upper dissolved bitumen solvent liquid phase from the lower solid phase; and (d) separating the dissolved bitumen from the solvent.

2. The method of claim 1 wherein about 7 to 15 weight % of the bitumen is undissolved.

3. The method of claim 1 wherein the amount of undissolved bitumen is sufficient to achieve a settling rate for the undissolved bitumen and agglomerated fines of at least 0.1 feet/hour.

4. A method for removing solid fines in an extraction of bitumen from a carbonaceous solid or carbonaceous liquid containing extractable bitumen comprising:

(a) contacting the the carbonaceous solid or carbonaceous liquid containing extractable bitumen with a solvent mixture having a solubility parameter between about 8.5 and about 10.5 to produce a bitumen laden solvent mixture, wherein the solvent mixture comprises at least one solvent with a solubility parameter higher than that of bitumen and at least one solvent with a solubility parameter lower than that of bitumen;

(b) separating sand from the bitumen laden solvent mixture;

(c) treating the bitumen laden solvent mixture to remove the higher solubility parameter solvent so that an asphaltene fraction of the bitumen is precipitated from the remaining solvent to form a mixture comprising dissolved bitumen, undissolved asphaltenic bitumen, solid fines, and solvent;

(d) permitting the undissolved asphaltenic bitumen to settle with at least a portion of the solid fines, agglomerating and settling with the undissolved asphaltenic bitumen;

(e) separating the undissolved bitumen and solid fines; and (f) stripping the remaining solvent from the dissolved bitumen to produce product bitumen.

5. The method of claim 4 wherein the amount of undissolved asphaltenic bitumen is about 7 to about 15 weight percent.

6. The method of claim 4 wherein the higher solubility parameter solvent is selected from the group consisting of toluene, benzene, chlorobenzene, nitrobenzene, furan, dimethyl sulfide, carbon disulfide, triophene, pyridine, ketones of carbon number 5 or less, alcohols of carbon number 4 or less, chlorinated compounds of carbon number 2 or less, and mixtures thereof.

7. The method of claim 4 wherein the lower solubility parameter solvent is selected from the group consisting of cyclopentane, cyclohexane, naptha, kerosine, Freon-11, Freon-113, paraffins and olefins of carbon number 3 through 12, and mixtures thereof.

8. The method of claim 4 wherein the lower solubility parameter solvent is selected from the group consisting of paraffins of carbon number 8 to 12.

9. The method of claim 1 wherein the carbonaceous solid comprises tar sand, diatomaceous earth or a solid containing heavy oil.

10. The method of claim 1 wherein the solvent comprises at least one nonpolar hydrocarbon which is unsubstituted or substituted by at least one halogen, oxygen, nitrogen or sulfur atom and has from 1 to 15 carbon atoms.

* * * * *